US008834096B2

(12) United States Patent
Khanin

(10) Patent No.: US 8,834,096 B2
(45) Date of Patent: Sep. 16, 2014

(54) AXIAL FLOW GAS TURBINE

(75) Inventor: Alexander Anatolievich Khanin, Moscow (RU)

(73) Assignee: Alstom Technology Ltd., Baden (CH)

( * ) Notice: Subject to any disclaimer, the term of this patent is extended or adjusted under 35 U.S.C. 154(b) by 491 days.

(21) Appl. No.: 13/306,063

(22) Filed: Nov. 29, 2011

(65) Prior Publication Data

US 2012/0134780 A1 May 31, 2012

(30) Foreign Application Priority Data

Nov. 29, 2010 (RU) ..... 2010148720

(51) Int. Cl.

| | |
|---|---|
| ***F01D 11/10*** | (2006.01) |
| ***F01D 25/12*** | (2006.01) |
| ***F01D 25/24*** | (2006.01) |
| ***F01D 5/22*** | (2006.01) |
| *F01D 11/12* | (2006.01) |

(52) U.S. Cl.

CPC ..... *F01D 5/225* (2013.01); *F05D 2260/205* (2013.01); *F05D 2300/5021* (2013.01); *F05D 2240/11* (2013.01); *F01D 11/10* (2013.01); *F05D 2240/81* (2013.01); *F01D 11/12* (2013.01); *F01D 25/246* (2013.01)

USPC ..... 415/116; 415/173.5; 415/173.6; 415/174.5

(58) Field of Classification Search

USPC ..... 415/115, 116, 108, 191, 177, 170.1, 415/173.1, 173.5, 173.6, 174.5

See application file for complete search history.

(56) References Cited

U.S. PATENT DOCUMENTS

| | | | | |
|---|---|---|---|---|
| 2,910,269 | A * | 10/1959 | Haworth et al. | 415/173.6 |
| 5,044,881 | A * | 9/1991 | Dodd et al. | 415/173.3 |
| 5,899,660 | A * | 5/1999 | Dodd | 415/9 |
| 6,126,390 | A * | 10/2000 | Bock | 415/115 |
| 6,254,345 | B1 * | 7/2001 | Harris et al. | 416/96 R |
| 6,588,764 | B2 * | 7/2003 | Fuller | 277/547 |

(Continued)

FOREIGN PATENT DOCUMENTS

| | | |
|---|---|---|
| EP | 1 083 299 | 3/2001 |
| EP | 1 219 788 | 7/2002 |
| GB | 2445075 | 6/2008 |
| WO | WO2009/153108 | 12/2009 |

OTHER PUBLICATIONS

Partial European Search Report for EP Patent App. No. 11190902.4 (Mar. 14, 2012).

(Continued)

*Primary Examiner* — Edward Look
*Assistant Examiner* — Wayne A Lambert
(74) *Attorney, Agent, or Firm* — Buchanan Ingersoll & Rooney PC

(57) ABSTRACT

In an axial flow gas turbine efficient cooling and a long life-time can be achieved by providing the outer blade platforms (45) with a plurality of outer teeth (46*a-c*) running parallel to each other in the circumferential direction and being arranged one after the other in the direction of the hot gas flow. The teeth (46*a-c*) are divided into first and second teeth (46*a;* 46*b-c*), the second teeth (46*b-c*) being located downstream of the first teeth (46*a*), the first teeth (46*a*) are opposite to a downstream projection (33) of the adjacent vanes (21) of the turbine stage (TS), and the second teeth (46*b-c*) are opposite to the respective stator heat shields (27).

6 Claims, 3 Drawing Sheets

(56) References Cited

U.S. PATENT DOCUMENTS

| | | | | |
|---|---|---|---|---|
| 6,652,228 | B2 * | 11/2003 | Tiemann | 415/178 |
| 7,273,347 | B2 * | 9/2007 | Rathmann | 415/173.6 |
| 2002/0085909 | A1 * | 7/2002 | Bekrenev | 415/115 |
| 2004/0258517 | A1 * | 12/2004 | Naik et al. | 415/116 |
| 2004/0258523 | A1 * | 12/2004 | Naik et al. | 416/116 |
| 2007/0098546 | A1 * | 5/2007 | Cairo et al. | 415/170.1 |
| 2009/0081024 | A1 * | 3/2009 | Tibbott | 415/115 |
| 2010/0189542 | A1 * | 7/2010 | Maltson | 415/1 |
| 2010/0247298 | A1 | 9/2010 | Nakamura et al. | |
| 2011/0085894 | A1 * | 4/2011 | Dueckershoff et al. | 415/175 |

OTHER PUBLICATIONS

European Search Report for EP Patent App. No. 11190902.4 (Sep. 19, 2012).

* cited by examiner

AXIAL FLOW GAS TURBINE

This application claims priority under 35 U.S.C. 119 to Russian Federation application no. 2010148720, filed 29 Nov. 2010, the entirety of which is incorporated by reference herein.

BACKGROUND

1. Field of Endeavor

The present invention relates to gas turbines, and more specifically to an axial flow gas turbine Yet more specifically, the invention relates to a stator heat shield protecting the vane carrier of an axial-flow turbine used in a gas turbine unit.

2. Brief Description of the Related Art

An example of an axial flow gas turbine is shown in FIG. 1. The gas turbine 10 of FIG. 1 operates according to the principle of sequential combustion. It includes a compressor 11, a first combustion chamber 14 with a plurality of burners 13 and a first fuel supply 12, a high-pressure turbine 15, a second combustion chamber 17 with the second fuel supply 16, and a low-pressure turbine 18 with alternating rows of blades 20 and vanes 21, which are arranged in a plurality of turbine stages arranged along the machine axis MA.

The gas turbine 10 according to FIG. 1 includes a stator and a rotor. The stator includes a vane carrier 19 with the vanes 21 mounted therein; these vanes 21 are necessary to form profiled channels where hot gas developed in the combustion chamber 17 flows through. Gas flowing through the hot gas path 22 in the required direction hits against the blades 20 installed in shaft slits of a rotor shaft and causes the turbine rotor to rotate. To protect the stator housing against the hot gas flowing above the blades 20, stator heat shields installed between adjacent vane rows are used. High temperature turbine stages require cooling air to be supplied into vanes, stator heat shields, and blades.

The stator heat shields are installed in gas turbine housings above blade rows. The stator heat shields preclude hot gas penetration into the cooling air cavity and form the outer surface of the turbine flow path 22. For the purposes of economy, sometimes a cooling air supply between a vane carrier and a stator heat shield is not used. However, in this case stator heat shields are also necessary to protect the vane carrier.

SUMMARY

One of numerous aspects of the present invention includes a gas turbine with an improved and highly efficient cooling scheme Another aspect includes a gas turbine that comprises a rotor with alternating rows of air-cooled blades and rotor heat shields, and a stator with alternating rows of air-cooled vanes and stator heat shields mounted on a vane carrier, whereby the stator coaxially surrounds the rotor to define a hot gas path in between, such that the rows of blades and stator heat shields, and the rows of vanes and rotor heat shields are opposite to each other, respectively, and a row of vanes and the next row of blades in the downstream direction define a turbine stage, and whereby the blades are provided with outer blade platforms at their tips.

Yet another aspect includes that the outer blade platforms comprise on their outside a plurality of teeth running parallel to each other in the circumferential direction and being arranged one after the other in the direction of the hot gas flow, said teeth are divided into first and second teeth, whereby the second teeth are located downstream of the first teeth, the first teeth are opposite to a downstream projection of the adjacent vanes of the turbine stage, and the second teeth are opposite to the respective stator heat shields. With such an axially "shortened" version of the stator heat shields it especially becomes possible to feed air used up in the adjacent vane airfoil to simultaneously protect the stator heat shield and cool the outer blade platform.

Another aspect includes that the blade platforms comprise, on their outside, three teeth, the first teeth comprise the first tooth in the downstream direction, and the second teeth comprise the second and third tooth in the downstream direction.

In yet another aspect, the adjacent vanes of the turbine stage are cooled with cooling air, and the utilized air from the adjacent vanes effuses between the stator heat shields and the adjacent vanes into the hot gas path to flow along and externally cool the stator heat shields and opposite outer blade platforms.

Another aspect includes that the stator heat shields are mounted on an inner ring, which on its part is mounted on the vane carrier with a first cavity being provided between the inner ring and the vane carrier, and the vanes are mounted on the vane carrier with a second cavity being provided between the vanes and the vane carrier, which second cavity is supplied with cooling air from a plenum, whereby a leakage of cooling air from the first and second cavities exists between the stator heat shields and the adjacent vanes with their downstream protections, and whereby the leaked cooling air flows along the outside of the outer blade platforms in the downstream direction.

Another aspect includes that the stator heat shields are each mounted on an inner ring with the possibility of extending freely under action of heat in both axial and circumferential directions by a forward hook and a rear hook being integral with the stator heat shields and extending in the circumferential direction, and the rear hooks are each chamfered at both ends over a predetermined length to reduce high stress concentrations due to high temperature deformation of the stator heat shields.

Another aspect includes that the stator heat shields are fixed in a circumferential slot of the inner ring in the axial direction by a radial projection, and in the circumferential direction by a pin, which enters into an axial slot under the action of the spring.

BRIEF DESCRIPTION OF THE DRAWINGS

The present invention is now to be explained more closely by means of different embodiments and with reference to the attached drawings.

DETAILED DESCRIPTION OF EXEMPLARY EMBODIMENTS

Figure 1:
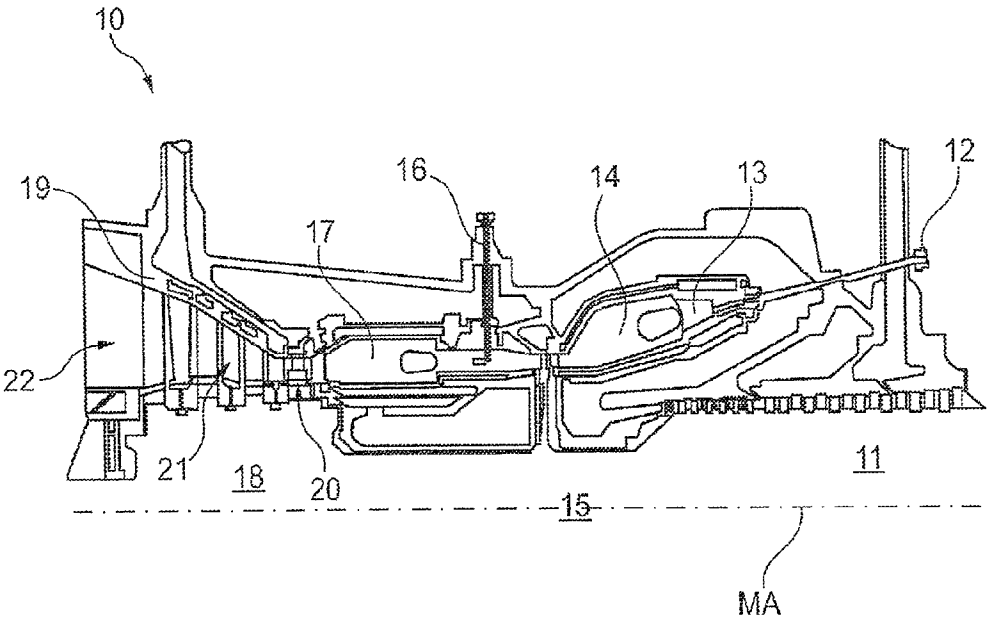
Fig. 1 PRIOR ART
FIG. 1 shows a well-known basic design of a gas turbine with sequential combustion, which may be a starting point for practicing the invention.
Figure 2:
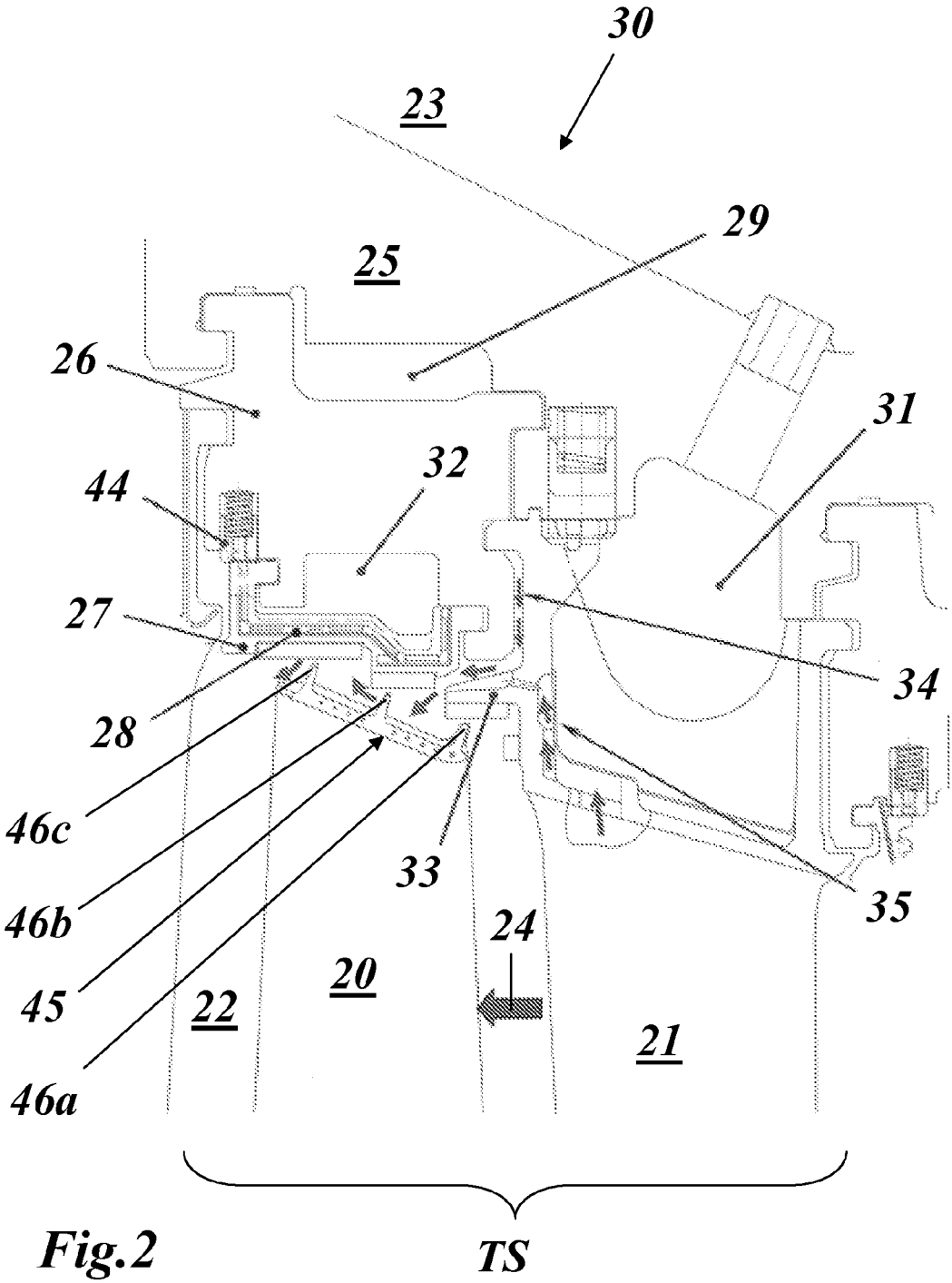
FIG. 2 shows mounting and cooling details of a turbine stage of a gas turbine according to an embodiment of the invention.

FIG. 2 shows mounting and cooling details of a turbine stage TS of a gas turbine 30 according to an exemplary embodiment of the invention. The turbine stage TS, with its hot gas path 22 and hot gas 24 flowing in the axial direction, includes a row of blades 20, each equipped on its tip with an outer blade platform 45, and a row of adjacent vanes 21. The vanes 21 are mounted to a vane carrier 25. Cooling air from the plenum 23 enters a cavity 31 located between the vanes 21 and the vane carrier 25. From the cavity 31 cooling air is supplied to the airfoils of a vanes 21 with the utilized air 35 exiting the airfoil and the vane above a rear or downstream projection 33 (see the arrows in FIG. 2).

Figure 3:
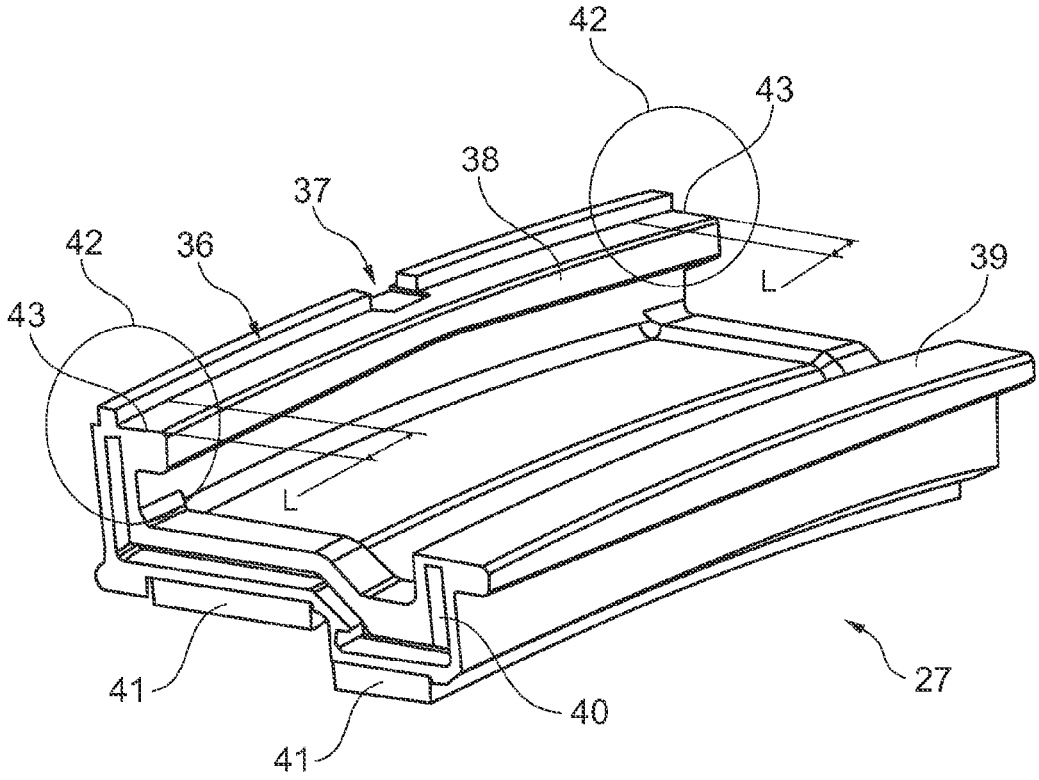
FIG. 3 shows in a perspective view a single stator heat shield according to FIG. 2.

Opposite to the row of blades 20 there is positioned a ring of segmented stator heat shields 27, which are each mounted to an inner ring 26. A single stator heat shield 27 is shown in a perspective view in FIG. 3. The inner ring 26 itself is mounted to the vane carrier 25 with the cavity 29 in between. Another cavity 32 is provided between the stator heat shields 27 and the inner ring 26. To seal the cavity 32 between adjacent stator heat shields 27 in the circumferential direction, sealing plates 28 (FIG. 2) are provided in respective slots 40 (FIG. 3).

The stator heat shields 27 can have diverse shapes depending on the design of the vane carrier 25 and the outer blade platform 45. The shape disclosed in FIGS. 2 and 3 demonstrates a proposed design of the stator heat shield positioned above a blade 20 with three teeth 46*a-c* arranged on the outside of the outer blade platform 45.

The inner ring 26, which carries the stator heat shields 27, is mounted in respective slots of the vane carrier 25. The stator heat shields 27 are fixed in a slot in the inner ring 26 in the axial direction by a radial projection 36 (see FIG. 3), and in the circumferential direction by a pin 44 (see FIG. 2), which during mounting of the stator heat shield 27 enters into an (axial) slot 37 (see FIG. 3) under the action of a spring (see FIG. 2).

Thus, due to this kind of mounting, the stator heat shields 27 can extend freely under action of heat in both the axial and circumferential directions. As can be seen in FIG. 2, the stator heat shields 27 of this embodiment are only provided with honeycombs (41 in FIG. 3) for the second and third blade teeth 46*b* and 46*c*, while the first tooth 46*a* is not covered by the stator heat shield. Opposite to the first tooth 46*a* is a rear or downstream projection 33 (with a respective honeycomb) provided at the adjacent vanes 21.

Such a design makes it possible to avoid both additional cooling air supply into the cavity 32 to cool the stator heat shields 27 and further transportation of this air through holes within the stator heat shields to cool the opposite outer blade platforms 45.

Thus, a non-cooled stator heat shield is proposed. Furthermore, the outer blade platform 45 is assumed to be cooled by air used up in the vane airfoil (utilized air 35). In so doing, turbine efficiency increases due to this double cooling air utilization.

As shown in FIG. 3, the stator heat shield 27 has a rear hook 38 and a forward hook 39 running in the circumferential direction. In connection with the cooling scheme explained above, it is advantageous to provide the stator heat shields 27 in accordance with FIG. 3 with special chamfers made in outer surfaces at both ends of the rear hooks 38 within zones 42 over a predetermined length L. This chamfer is helpful from the viewpoint of mechanical integrity, since when a stator heat shield is operated under high temperature conditions, the edges 43 of the rear hook 38 strive to displace in the radial direction relative to the inner ring 26. If there were no chamfers over the length L, a very high stress concentration would occur at the edges 43, and the life-time of the stator heat shields 27 would decrease drastically.

On the other hand, no chamfers are provided at the forward hook 39, since with regard to shape of the outer blade platform, the stator heat shield 27 is provided there with a flexure to increase its stiffness in its forward portion.

Some characteristics and advantages can be summarized as follows:

1. The "shortened" version of the stator heat shields, provided with honeycomb above the last two outer blade platform teeth 46*b,c*, provides the possibility of using air, which has already been utilized in the vane airfoil, for simultaneous protection of the stator heat shields and cooling the outer blade platform 45 (see FIG. 2). The shortened stator heat shield shape enables a honeycomb to be arranged on the vane projection 33 above the first tooth 46*a* of the outer blade platform 45, which precludes any possibility for leakage of utilized air in front of the first tooth 46*a* of the outer blade platform 45.

2. The shortened version of the stator heat shield 27, provided with honeycombs above the last blade platform teeth 46*b, c*, provides the possibility of using cooling air leakages 34 from cavities 29 and 31 for additional cooling of the platform 45 since the projection 33 rules out any possibility for air leakage upstream of the first tooth 46*a* of blade platform 45.

3. Chamfers in the rear hook 38 of the stator heat shield 27 reduce the stress level in the stator heat shield 27 to a sufficient extent, and increase its life-time considerably, when it is operated in the gas turbine.

The combination of stress-decreasing chamfers and a shortened part shape in the same stator heat shield simultaneously makes it possible to create a non-cooled stator heat shield with a long-term lifespan, and increase turbine efficiency due to air saving.

LIST OF REFERENCE NUMERALS

10,30 gas turbine
11 compressor
12,16 fuel supply
13 burner
14,17 combustion chamber
15 high-pressure turbine
18 low-pressure turbine
19 vane carrier (stator)
20 blade
21 vane
22 hot gas path
23 plenum
24 hot gas
25 vane carrier
26 inner ring
27 stator heat shield
28 sealing plate
29,31,32 cavity
33,36 projection
34 leakage
35 utilized air
37 slot
38 rear hook
39 forward hook
40 slot (for sealing plates)
41 honeycomb
42 zone
43 edge
44 pin
45 blade outer platform
46*a-c* tooth
L length
MA machine axis
TS turbine stage While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. An axial flow gas turbine comprising:

a rotor including alternating rows of air-cooled blades and rotor heat shields, and a stator including inner rings, alternating rows of air-cooled vanes, and stator heat shields mounted on the inner rings, wherein the stator coaxially surrounds the rotor to define a hot gas path therebetween, such that the rows of blades and stator heat shields, and the rows of vanes and rotor heat shields, are opposite to each other, respectively, and a row of vanes and an adjacent row of blades in the downstream direction define a turbine stage, wherein at least one of the vanes includes a projection extending downstream, and wherein the blades comprise tips and outer blade platforms at the tips; and wherein the outer blade platforms comprise a plurality of radially outer teeth running parallel to each other in the circumferential direction and being arranged one after the other in the direction of the hot gas flow, said teeth being divided into first and second teeth, wherein the second teeth are positioned downstream of the first teeth, wherein the first teeth are opposite to said projection of adjacent vanes of the turbine stage, and wherein the second teeth are opposite to respective stator heat shields.

2. An axial flow gas turbine according to claim 1, wherein the blade platforms comprise three outer teeth, a first of which comprises the first tooth in the downstream direction, and a second of which comprises the second and third tooth in the downstream direction.

3. An axial flow gas turbine according to claim 1, wherein the adjacent vanes of the turbine stage are configured and arranged to be cooled with cooling air, and the utilized air from the adjacent vanes effuses between the stator heat shields and the adjacent vanes into the hot gas path to flow along and externally cool the stator heat shields and opposite outer blade platforms.

4. An axial flow gas turbine according to claim 1, further comprising:

an inner ring mounted on a vane carrier;

a first cavity between the inner ring and the vane carrier;

a plenum;

a second cavity between the vanes and the vane carrier, the second cavity being configured and arranged to be supplied with cooling air from the plenum;

wherein the stator heat shields are mounted on the inner ring;

wherein the vanes are mounted on the vane carrier; and wherein a leakage of cooling air from the first and second cavities exits between the stator heat shields and adjacent vanes with said downstream protections, such that the leaked cooling air flows along the outside of the outer blade platforms in the downstream direction.

5. An axial flow gas turbine according to claim 1, wherein:

the stator heat shields each comprise a forward hook and a rear hook, both hooks extending circumferentially;

the stator heat shields are each mounted on an inner ring by the forward hook and the rear hook; and the rear hooks each comprise a chamfer at both ends over a predetermined length configured and arranged to reduce high stress concentrations due to high temperature deformation of the stator heat shields.

6. An axial flow gas turbine according to claim 5, further comprising:

a circumferential slot in the inner ring;

a radial projection, an axial slot, a spring, and a pin in the stator heat shield, wherein the spring forces the pin into the axial slot; and wherein the stator heat shields are axially fixed by the radial projection and circumferentially fixed by the pin.

* * * * *